US008326609B2

(12) United States Patent
Oh

(10) Patent No.: US 8,326,609 B2
(45) Date of Patent: Dec. 4, 2012

(54) METHOD AND APPARATUS FOR AN AUDIO SIGNAL PROCESSING

(75) Inventor: Hyeon O Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 1010 days.

(21) Appl. No.: 12/306,811

(22) PCT Filed: Jun. 29, 2007

(86) PCT No.: PCT/KR2007/003176

§ 371 (c)(1),
(2), (4) Date: Dec. 29, 2008

(87) PCT Pub. No.: WO2008/002098

PCT Pub. Date: Jan. 3, 2008

(65) Prior Publication Data

US 2009/0278995 A1 Nov. 12, 2009

Related U.S. Application Data

(60) Provisional application No. 60/865,916, filed on Nov. 15, 2006, provisional application No. 60/829,239, filed on Oct. 12, 2006, provisional application No. 60/817,805, filed on Jun. 29, 2006.

(51) Int. Cl.
*G10L 11/04* (2006.01)
*G10L 19/00* (2006.01)

(52) U.S. Cl. ..... 704/206; 704/220

(58) Field of Classification Search ..... 704/206, 704/220

See application file for complete search history.

(56) References Cited

U.S. PATENT DOCUMENTS

| | | | | | |
|---|---|---|---|---|---|
| 4,991,215 | A | * | 2/1991 | Taguchi | 704/216 |
| 5,479,445 | A | * | 12/1995 | Kloker et al. | 375/220 |
| 5,668,924 | A | * | 9/1997 | Takahashi | 704/219 |
| 5,684,791 | A | * | 11/1997 | Raychaudhuri et al. | 370/310.2 |
| 5,694,332 | A | * | 12/1997 | Maturi | 700/94 |
| 5,694,522 | A | * | 12/1997 | Hiratsuka et al. | 704/265 |
| 5,778,334 | A | * | 7/1998 | Ozawa et al. | 704/219 |
| 5,815,730 | A | * | 9/1998 | Kim | 710/5 |
| 5,918,205 | A | * | 6/1999 | Dierke | 704/230 |
| 5,956,674 | A | * | 9/1999 | Smyth et al. | 704/200.1 |
| 5,970,205 | A | * | 10/1999 | Nakamura et al. | 386/314 |
| 6,012,026 | A | * | 1/2000 | Taori et al. | 704/229 |
| 6,041,295 | A | * | 3/2000 | Hinderks | 704/206 |
| 6,249,764 | B1 | * | 6/2001 | Kamae et al. | 704/270.1 |
| 6,275,804 | B1 | * | 8/2001 | Carl et al. | 704/270 |
| 6,292,774 | B1 | * | 9/2001 | Taori et al. | 704/201 |
| 6,385,570 | B1 | * | 5/2002 | Kim | 704/200 |
| 6,523,003 | B1 | * | 2/2003 | Chandran et al. | 704/225 |
| 6,539,065 | B1 | | 3/2003 | Furukawa | |

(Continued)

FOREIGN PATENT DOCUMENTS

EP 0 677 961 A2 10/1995

(Continued)

*Primary Examiner* — Eric Yen
(74) *Attorney, Agent, or Firm* — Birch, Stewart, Kolasch & Birch, LLP

(57) ABSTRACT

An apparatus for processing an audio signal and method thereof are disclosed, by which the audio signal can be efficiently processed. The present invention includes obtaining start position information of a sub-frame from a header of the main frame and processing an audio signal based on the start position information of the sub-frame, wherein the main frame includes a plurality of sub-frames.

10 Claims, 9 Drawing Sheets

U.S. PATENT DOCUMENTS 6,556,966 B1 * 4/2003 Gao ..... 704/220
6,581,030 B1 * 6/2003 Su ..... 704/219
6,721,710 B1 * 4/2004 Lueck et al. ..... 704/500
6,732,072 B1 * 5/2004 Pearce et al. ..... 704/231
6,744,473 B2 * 6/2004 Wells ..... 348/515
6,772,127 B2 * 8/2004 Saunders et al. ..... 704/500
6,836,514 B2 12/2004 Gandhi et al.
6,970,478 B1 * 11/2005 Nishihara ..... 370/474
6,999,090 B2 2/2006 Obata et al.
7,054,697 B1 * 5/2006 Nishiwaki et al. ..... 700/94
7,061,982 B2 * 6/2006 Ueda ..... 375/240.25
7,107,111 B2 * 9/2006 Van De Kerkhof et al. .... 700/94
7,149,159 B2 * 12/2006 Oomen et al. ..... 369/47.13
7,256,340 B2 * 8/2007 Okazaki et al. ..... 84/604
7,299,176 B1 * 11/2007 Lee et al. ..... 704/228
7,333,929 B1 * 2/2008 Chmounk et al. ..... 704/200
7,366,733 B2 * 4/2008 Matsumi et al. ..... 707/821
7,571,094 B2 * 8/2009 Goudar ..... 704/221
7,689,429 B2 * 3/2010 Zhou et al. ..... 704/503
7,917,237 B2 * 3/2011 Kawamura et al. ..... 700/94
7,924,929 B2 * 4/2011 Meenakshisundaram et al. ..... 375/240.28
7,970,602 B2 * 6/2011 Toma et al. ..... 704/201
8,073,702 B2 * 12/2011 Pang et al. ..... 704/500
2001/0010040 A1 * 7/2001 Hinderks ..... 704/500
2001/0041981 A1 * 11/2001 Ekudden et al. ..... 704/270.1
2002/0085556 A1 * 7/2002 Hong ..... 370/389
2002/0150100 A1 * 10/2002 White et al. ..... 370/392
2002/0191963 A1 12/2002 Kikuchi et al.
2003/0158740 A1 * 8/2003 Tsai et al. ..... 704/500
2004/0083258 A1 * 4/2004 Haneda et al. ..... 709/201
2004/0249862 A1 * 12/2004 Shin et al. ..... 707/104.1
2005/0171763 A1 * 8/2005 Zhou et al. ..... 704/201
2005/0187777 A1 * 8/2005 Chevallier et al. ..... 704/500
2005/0234714 A1 * 10/2005 Takagi et al. ..... 704/225
2005/0283362 A1 * 12/2005 Nomura ..... 704/221
2006/0067345 A1 3/2006 Hayashi et al.
2006/0133618 A1 * 6/2006 Villemoes et al. ..... 381/20
2006/0271355 A1 * 11/2006 Wang et al. ..... 704/220
2006/0293902 A1 * 12/2006 Kim et al. ..... 704/500
2007/0162278 A1 * 7/2007 Miyasaka et al. ..... 704/201
2007/0203696 A1 * 8/2007 Sakazawa et al. ..... 704/229
2009/0228283 A1 * 9/2009 Toma et al. ..... 704/500

FOREIGN PATENT DOCUMENTS

EP 0 725 541 A2 8/1996
EP 1 596 592 A1 11/2005

* cited by examiner

FIG. 5

(a)

| Syntax | Bit |
|---|---|
| { | |
| bsRefreshPoint | 1 |
| } | |

(b)

| Syntax | Bit |
|---|---|
| { | |
| bsRefreshStart | 1 |
| if( bsRefreshStart ) | |
| bsRefreshDuration | n |
| } | |

(c)

| Syntax | Bit |
|---|---|
| { | |
| bsRefreshPoint | 1 |
| bsRefreshStop | 1 |
| } | |
| | |

FIG. 6

(a)

| Syntax | Bit |
|---|---|
| { | |
| bsRefreshPoint | 1 |
| if( bsRefreshPoint ) | |
| bsRefreshSource | m |
| } | |

(b)

| bsRefreshSource | Information |
|---|---|
| 0 | codec change |
| 1 | sampling frequency change |
| 2 | number of output channel change |
| 3 | program change |
| 4 | genre change |
| 5 | nothing changed |
| 6,7 | reserved |

FIG. 7

(a)

| Syntax | Bit |
|---|---|
| { | |
| bsRefreshPoint | 1 |
| if( bsRefreshPoint ) | |
| bsRefreshLevel | k |
| } | |

(b)

| bsRefreshLevel | Information |
|---|---|
| 0 | receive system reset |
| 1 | audio part reset |
| 2 | bitstream buffer reset |
| 3 | mute only |
| 4 | no action |
| 5,6,7 | reserved |

FIG. 10

| Default grid IID | Value (IID, dB) | CLD table index (fine quantizer) | CLD table index (coarse quantizer) |
|---|---|---|---|
| -7 | -25 | -10 (-25) | -10 |
| -6 | -18 | -8 (-19) | -8 |
| -5 | -14 | -6 (-13) | -6 |
| -4 | -10 | -5 (-10) | -4 |
| -3 | -7 | -4 (-8), -3 (-6) | -4 |
| -2 | -4 | -2 (-4) | -2 |
| -1 | -2 | -1 (-2) | 0 |
| 0 | 0 | 0 (0) | 0 |
| 1 | 2 | 1 | 0 |
| 2 | 4 | 2 | 2 |
| 3 | 7 | 3, 4 | 4 |
| 4 | 10 | 5 | 4 |
| 5 | 14 | 6 | 6 |
| 6 | 18 | 8 | 8 |
| 7 | 25 | 10 | 10 |

METHOD AND APPARATUS FOR AN AUDIO SIGNAL PROCESSING

This application is the National Phase of PCT/KR2007/003176 filed on Jun. 29, 2007, which claims priority under 35 U.S.C. 119(e) to U.S. Provisional Application Nos. 60/817,805 filed on Jun. 29, 2006, 60/829,239 filed on Oct. 12, 2006 and 60/865,916 filed on Nov. 15, 2006, respectively, all of which are hereby expressly incorporated by reference into the present application.

TECHNICAL FIELD

The present invention relates to digital broadcasting, and more particularly, to an apparatus for processing an audio signal and method thereof.

BACKGROUND ART

Recently, audio, video and data broadcasts are transmitted by a digital system instead of the conventional analog system. So, many efforts have been made to research and develop devices for transmitting and displaying the audio, video and data broadcasts. And, the devices have already been commercialized in part. For instance, a system for digitally transmitting audio broadcast, video broadcast, data broadcast and the like is so-called digital broadcasting. As the digital broadcasting, there is digital audio broadcasting, digital multimedia broadcasting, or the like.

The digital broadcasting is advantageous in providing various multimedia information services inexpensively, being utilized for mobile broadcasting according to frequency band allocation, creating new profit sources via additional data transport services, and bringing vast industrial effects by providing new vitamins to a receiver market.

Many technologies for signal compression and reconstruction have been introduced and are generally applied to various data including audio and video. Theses technologies tend to evolve in a direction for enhancing audio and video qualities with high compression ratio. And, many efforts have been made to raise transmission efficiency for the adaptation to various communication environments.

Generally, an audio signal can be generated by one of various coding schemes. Assuming that there are bitstreams encoded by first and second coding schemes, respectively, a decoder suitable for the second coding scheme is unable to decode the bitstream decoded by the first coding scheme.

DISCLOSURE OF THE INVENTION

Technical Problem

So, a new signal processing method is needed to maximize signal transmission efficiency in complicated communication environments.

And, for the bit sequence compatibility, it is necessary to generate a bitstream fitting for a format of an output signal by parsing a minimum bitstream from a transmitted signal.

Technical Solution

Accordingly, the present invention is directed to an apparatus for processing an audio signal and method thereof that substantially obviate one or more of the problems due to limitations and disadvantages of the related art.

An object of the present invention is to provide an apparatus for processing an audio signal and method thereof, by which the audio signal can be efficiently processed.

Another object of the present invention is to provide an apparatus for transmitting a signal, method thereof, and data structure implementing the same, by which more signals can be carried within a predetermined frequency band.

Another object of the present invention is to provide an apparatus for transmitting a signal and method thereof, by which a loss caused by error in a prescribed part of the transmitted signal can be reduced.

Another object of the present invention is to provide an apparatus for transmitting a signal and method thereof, by which signal transmission efficiency can be optimized.

Another object of the present invention is to provide an apparatus for transmitting a signal and method thereof, by which a broadcast signal using a plurality of codecs is efficiently processed.

Another object of the present invention is to provide an apparatus for data coding and method thereof, by which the data coding can be efficiently processed.

Another object of the present invention is to provide an apparatus for processing an audio signal and method thereof, by which compatibility between bitstreams respectively coded by different coding schemes can be provided.

Another object of the present invention is to provide an apparatus for processing an audio signal and method thereof, by which a bitstream encoded by a coding scheme different from that of a decoder can be decoded.

A further object of the present invention is to provide a system including a decoding apparatus.

Advantageous Effects

The present invention provides the following effects or advantages.

First of all, start position information of a sub-frame is inserted in a header area of a main frame of an audio signal. Hence, efficiency in data transmission can be raised.

Secondly, audio parameter information is used by being inserted in a header area of a main frame. Hence, various services can be provided and audio services coded by at least one scheme can be processed.

Thirdly, the present invention can process audio services coded by the related art or conventional schemes, thereby maintaining compatibility.

Fourthly, in transmitting consecutive data of broadcasting, communication, and the like, if a discontinuous section of data is generated by transmission error, a changed environment for requiring a reset of a decoder, a channel change by user's selection, or the like, refresh information is used to enable efficient management.

Fifthly, the present invention enables efficient data coding, thereby providing data compression and reconstruction with high transmission efficiency.

Sixthly, even if any kind of signal is transferred, a bitstream suitable for a corresponding format can be generated. Hence, compatibility between an encoded signal and a decoder can be enhanced. For instance, if a parametric stereo signal is transmitted to an MPEG surround decoder, the parametric stereo signal is converted and decoded using a converting unit within the MPEG surround decoder. This can be identically applied to a case that SAOC signal is transmitted instead of the parametric stereo signal, and vice versa.

Seventhly, in case that various signals are transmitted, a decoder is modified in part to enable the signals to be decoded. Hence, compatibility of the decoder can be enhanced.

DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 5 is a diagram to explain various examples for a method of transmitting refresh information according to an embodiment of the present invention;

(a) is a diagram to explain a transmitting method of inserting refresh point information (bsRefreshPoint) in a sub-frame;

(b) is a diagram to explain a transmitting method of inserting refresh start information (bsRefreshStart) in a sub-frame and inserting refresh duration information (bsRefreshDuration) indicating a duration available for refresh execution if refresh is applied;

(c) is a diagram to explain a transmitting method of inserting refresh point information (bsRefreshPoint) indicating refresh available and refresh stop information (bsRefreshStop) to stop the refresh in a sub-frame;

FIG. 6 is a diagram (a) to explain a method of transmitting reason information of refresh, and a diagram (b) to explain examples of reason information of refresh;

FIG. 7 is a diagram (a) to explain a method of transmitting level information to provide refresh extendibility, and an exemplary diagram of level information.

Figure 8:
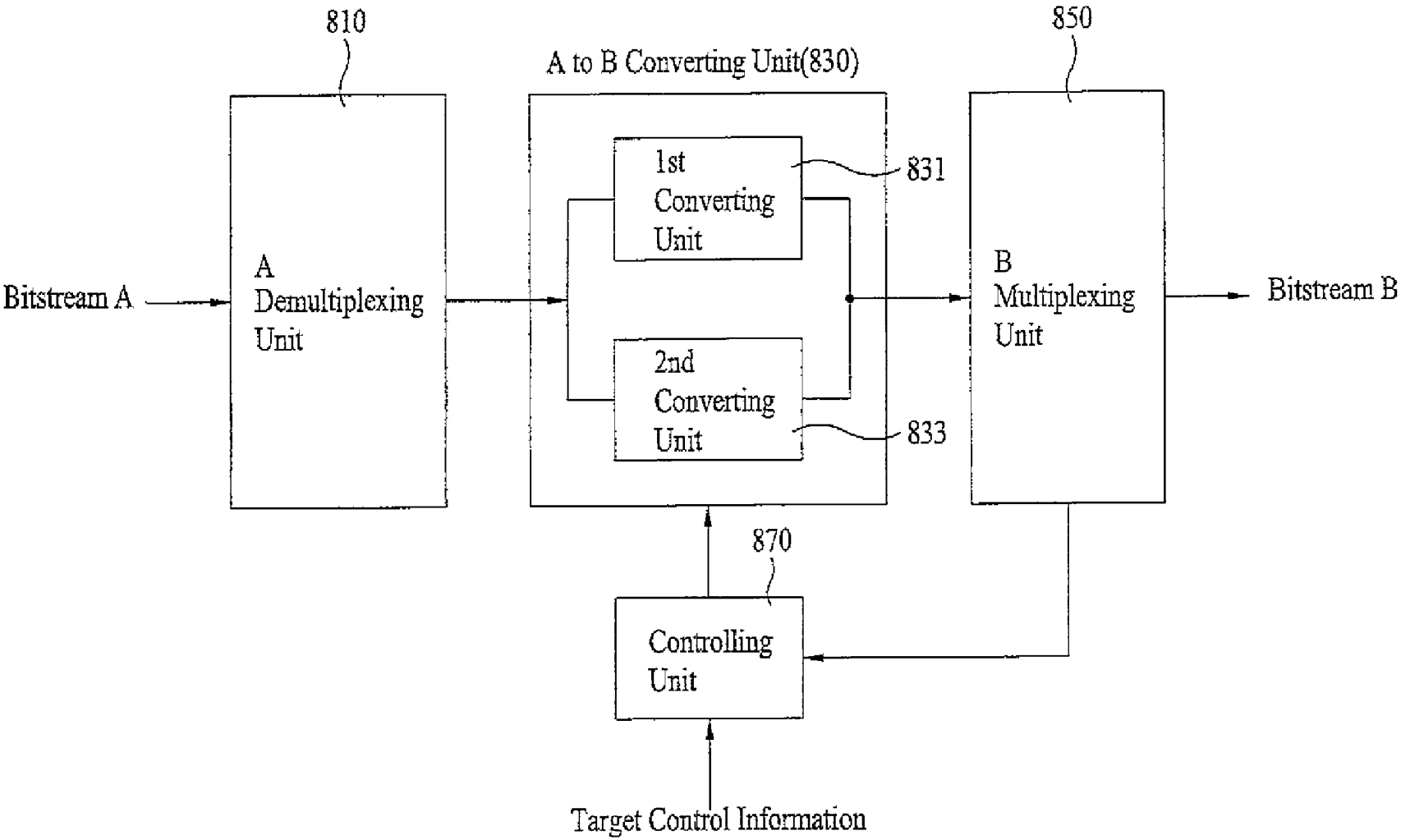
Figure 9:
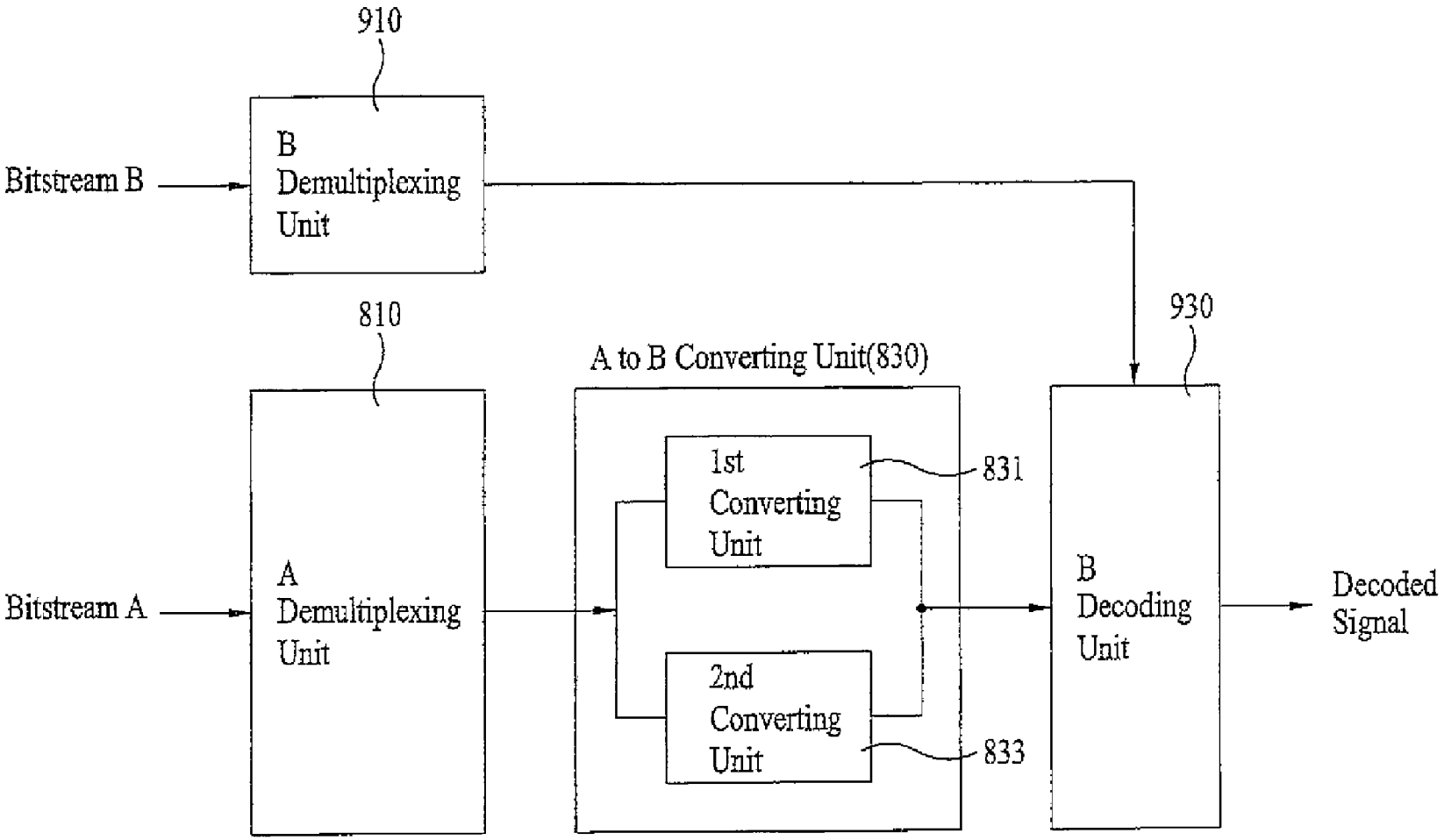

FIG. 8 is a schematic block diagram of a system for compatibility between bitstream-A and bitstream-B according to one embodiment of the present invention;

FIG. 9 is a schematic block diagram of a system for compatibility between bitstream-A and bitstream-B according to another embodiment of the present invention; and FIG. 10 is an exemplary diagram of parameter information converted in the course of converting a parametric stereo signal to an MPEG surround signal according to an embodiment of the present invention.

BEST MODE

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a method of processing an audio signal, includes obtaining start position information of a sub-frame from a header of the main frame and processing an audio signal based on the start position information of the sub-frame, wherein the main frame includes a plurality of sub-frames.

To further achieve these and other advantages and in accordance with the purpose of the present invention, a method of processing an audio signal, includes obtaining refresh information of a main frame or a sub-frame from a header of the main frame and processing the audio signal based on the refresh information, wherein the refresh information indicates whether the audio signal will be processed using additional information different from information of a previous or current main frame or sub-frame, and wherein the main frame includes a plurality of sub-frames.

To further achieve these and other advantages and in accordance with the purpose of the present invention, a method of transporting an audio signal, includes inserting start position information of a sub-frame in a header of a main frame and transmitting the audio signal having the start position information of the sub-frame inserted therein to a signal receiver, wherein the main frame includes a plurality of sub-frames.

To further achieve these and other advantages and in accordance with the purpose of the present invention, a method of transporting an audio signal, includes inserting refresh information of a main frame or a sub-frame in a header of the main frame and transmitting the audio signal having the refresh information inserted therein to a signal receiver, wherein the refresh information indicates whether the audio signal will be processed using additional information different from information of a previous or current main frame or sub-frame, and wherein the main frame includes a plurality of sub-frames.

To further achieve these and other advantages and in accordance with the purpose of the present invention, in a broadcast receiver capable of receiving a digital broadcast, a digital broadcast receiver includes a tuner unit receiving a broadcast stream configured in a manner that start position information of a sub-frame is inserted in a header of a main frame of an audio signal, wherein the audio signal includes the main frame, that includes a plurality of the sub-frames and has a specific value, a deciding unit deciding a position of the sub-frame of the received broadcast stream using the start position information, and a control unit controlling header information corresponding to the sub-frame to be used in processing the sub-frame according to a result of the deciding step.

To further achieve these and other advantages and in accordance with the purpose of the present invention, a method of processing a signal includes extracting first parameter information from a bitstream encoded by a first coding scheme, and converting the first parameter information to second parameter information required to a second coding scheme, and generating a bitstream encoded by the second coding scheme using the converted second parameter information, wherein the second parameter information corresponds to the first parameter information.

To further achieve these and other advantages and in accordance with the purpose of the present invention, a method of processing a signal includes extracting first parameter information from a bitstream encoded by a first coding scheme, and converting the first parameter information to second parameter information required to a second coding scheme, and outputting a bitstream decoded by the second coding scheme using the converted second parameter information, wherein the second parameter information corresponds to the first parameter information.

It is to be understood that both the foregoing general description and the following detailed description are exemplary and explanatory and are intended to provide further explanation of the invention as claimed.

MODE FOR INVENTION

Reference will now be made in detail to the preferred embodiments of the present invention, examples of which are illustrated in the accompanying drawings.

First of all, a broadcast receiver capable of processing an audio signal according to the present invention is explained as follows.

Figure 1:
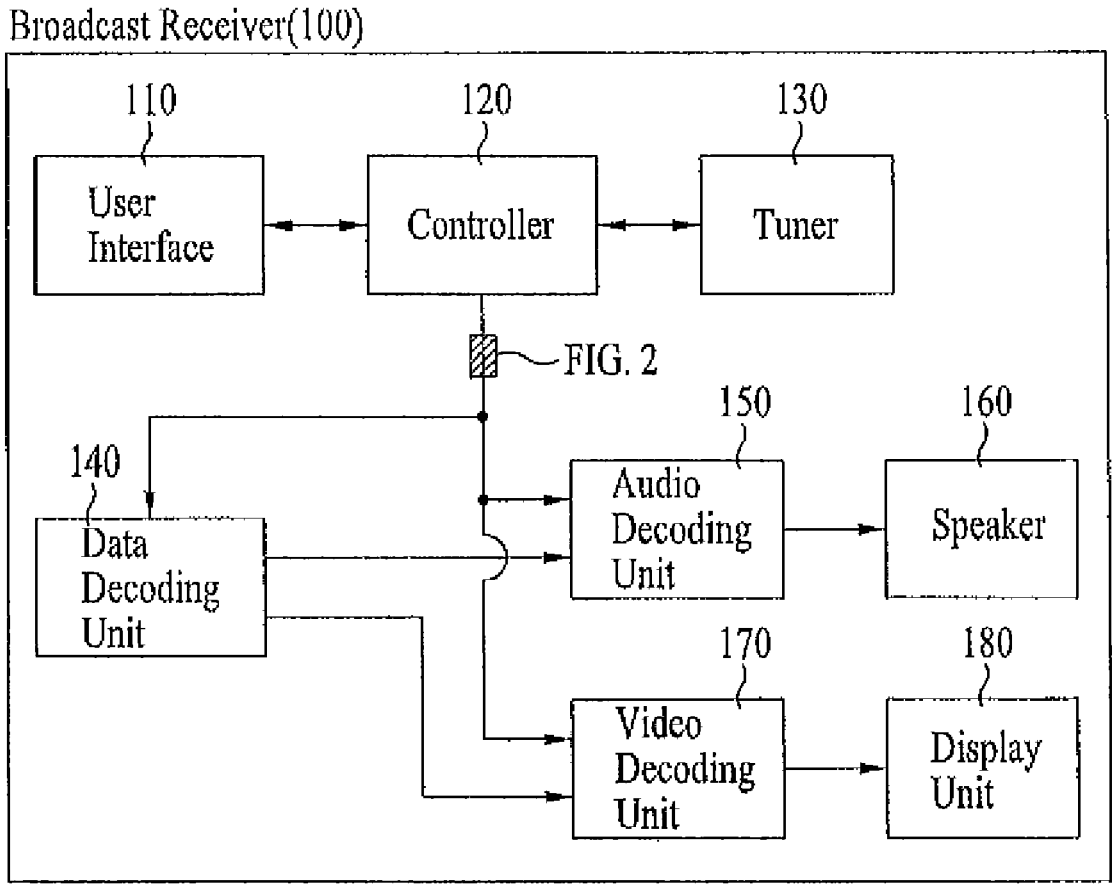
FIG. 1 is a schematic block diagram of a broadcast receiver 100 capable of receiving an audio signal according to an embodiment of the present invention.

FIG. 1 is a schematic block diagram of a broadcast receiver 100 capable of receiving an audio signal according to an embodiment of the present invention.

Referring to FIG. 1, a broadcast receiver 100 according to an embodiment of the present invention includes a user interface 110, a controller 120, a tuner 130, a data decoding unit 140, an audio decoding unit 150, a speaker 160, a video decoding unit 170, and a display unit 180.

In particular, the broadcast receiver 100 can include such a device capable of receiving to output a broadcast signal as a television, a mobile phone, a digital multimedia broadcast device, and the like.

If a user inputs a command for a channel adjustment, a volume adjustment, or the like, the user interface 110 plays a role in delivering the command to the controller 120.

The controller 120 plays a role in organically controlling functions of the user interface 110, the tuner 130, the data decoding unit 140, the audio decoding unit 150, and the video decoding unit 170.

The tuner 130 receives information for a channel from a frequency corresponding to control information of the controller 120. Information outputted from the tuner 130 is divided into main data and a plurality of service data to be demodulated by packet unit. These data are demultiplexed and then outputted to the corresponding data decoding units according to the control information of the controller 120, respectively. In this case, the data can include system information and broadcast service information. For instance, PSI/PSIP (program specific information/program and system information protocol) can be used as the system information, by which the present invention is not restricted. In particular, any protocol for transmitting system information in a table format is applicable to the present invention regardless of its name.

The data decoding unit 140 receives the system information or the broadcast service information and then performs decoding on the received information.

The audio decoding unit 150 receives an audio signal compressed by specific audio coding scheme and then reconfigures the received audio signal into a format outputtable via the speaker 160.

In particular, the audio signal can be encoded into sub-frames or frame units. A plurality of the encoded sub-frames can configure a main frame. The sub-frame means a minimum unit for transmitting or decoding. And the sub-frame may be an access unit or a frame.

Moreover, the sub-frame can include an audio sample. A header can exist in the main frame and information for an audio parameter can be included in the header of the main frame. For instance, the audio parameter can include sampling rate information, information indicating whether SBR (Spectral Band Replication) is used, channel mode information, information indicating whether parametric stereo is used, MPEG surround configuration information, etc.

So, the audio decoding unit 150 can include at least one of AAC decoder, AAC-SBR decoder, AAC-MPEG SURROUND decoder, and AAC-SBR (with MPEG SURROUND) decoder. And, start position information of the sub-frame and refresh information can be inserted in the header of the main frame.

The video decoding unit 170 receives a video signal compressed by specific video coding scheme and can reconfigure the received signal into a format outputtable via the display unit 180.

A method of processing a received signal more efficiently is explained in detail with reference to FIGS. 2 to 4. The received signal can include at least one of an audio signal, a video signal, and a data signal. As one embodiment of the present invention, a method of processing an audio signal is explained in detail as follows.

Figure 2:
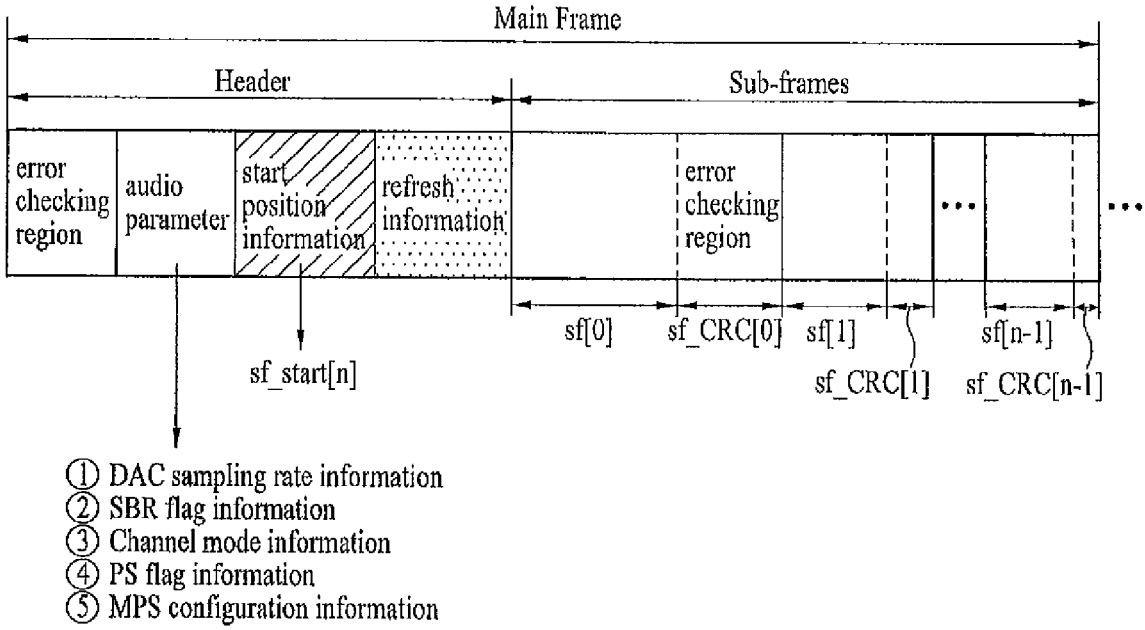
FIG. 2 is a schematic structural diagram of data of a main frame including a plurality of sub-frames according to an embodiment of the present invention.

FIG. 2 is a schematic structural diagram of data of a main frame including a plurality of sub-frames according to an embodiment of the present invention.

Referring to FIG. 2, digital audio broadcasting is capable of transmitting various kinds of additional data as well as transmitting audios on various channels for high quality. In transmitting the audio signal, it is able to encode the audio signal into sub-frames. And, the at least one encoded sub-frame can configure a main frame.

So, if error occurs in a portion of the main frame, it is highly probable that other data can be lost. To prevent this loss, it is necessary to define information indicating a length of the main frame or sub-frames.

The information indicating the length of the main frame or the sub-frames can be inserted in the header of the main frame. If the information indicating the length does not exist in the header of the main frame, the each sub-frame is sequentially searched, a length of each sub-frame is read, a next sub-frame is searched by jumping to the corresponding value of the read length, a length of the next sub-frame is then read. So, this is inconvenient and inefficient.

Yet, if the length of the main frame or the sub-frames is obtained from the header of the main frame, the above-explained problem of inefficiency can be solved.

In case that error occurs in one sub-frame within the main frame, it is unable to know a position of a sub-frame next to the erroneous sub-frame. So, in the present invention, start position information of a sub-frame can be used as an example of the information indicating the length of the main frame or the sub-frames.

The start position information is not the value indicating a length of the sub-frame but the value indicating a start position of the sub-frame. The start position information can be defined in various ways.

For instance, it is able to obtain relative position information of the sub-frame by representing the start position information as a fixed number of bits. In this case, it is able to know a size and position of a specific sub-frame. In particular, by notifying a start position value of a sub-frame, even if a start position value of a previous sub-frame is lost by error, it is able to decode data of a corresponding sub-frame with a start position value of a next sub-frame. Thus, if the start position information is a value that indicates a start position of the sub-frame, the value can be a value of an ascending order.

According to an embodiment of the present invention, start position information (sf_start[0]) of an initial sub-frame within a main frame can be given by preset information instead of being transmitted. For instance, a start position information value can be decided according to number information of sub-frames configuring the main frame. The start position information value of the initial sub-frame can be decided based on a header length of the main frame. In particular, if the number of sub-frames configuring the main frame is 2, the start position information value of the initial sub-frame can indicates 5-byte point of the main frame. In this case, the 5 bytes may correspond to a length of the header.

According to another embodiment of the present invention, various kinds of information can be included in the header of the main frame configuring the audio signal. For instance, the various kinds of information can include information for checking whether error exists in the header of the main frame, audio parameter information, start position information, refresh information, etc.

In this case, the start position information can be obtained from each sub-frame. In doing so, it has to be preferentially decided how many sub-frames exist within the main frame. For instance, the number information of the sub-frames can be obtained using the audio parameter. The audio parameter includes sampling rate information, information indicating whether SBR is used, channel mode information, information indicating whether parametric stereo is used, MPEG surround configuration information, etc. The sampling rate information can include DAC sampling rate information.

In particular, the DAC sampling rate information means a sampling rate of DAC (digital-to-analog converter). And, the DAC is a device for converting a digitally processed final audio sample to an analog signal to send to a speaker. And, the sampling rate means how many signals of samples are taken per second. So, the DAC sampling rate should be equal to a sampling rate in making an original analog signal into a digital signal.

The information indicating whether SBR (spectral band replication) is used is the information indicating whether the SBR is applied or not. The SBR (spectral band replication) means a technique of estimating a high frequency band component using information of a low frequency band. For instance, if the SBR is applied, when an audio signal is sampled at 48 kHz, an AAC (Advanced Audio Coding) sampling rate becomes 24 kHz.

The channel mode information is the information indicating whether an encoded audio signal corresponds to mono or stereo.

The information indicating whether PS (parametric stereo) is used means the information indicating whether parametric stereo is used. The PS indicates a technique of making an audio signal having one channel (mono) into an audio signal having two channels (stereo). So, if the PS is used, the channel mode information should be mono. And, the PS is usable only if the SBR is applied.

And, the MPEG surround configuration information means the information indicating what kind of MPEG surround having prescribed output channel information is applied. For instance, the MPEG surround configuration information indicates whether 5.1-output channel MPEG surround is applied, whether 7.1-output channel MPEG surround is applied, or whether MPEG surround is applied or not.

According to an embodiment of the present invention, number information of sub-frames configuring a main frame can be decided using the audio parameter. For instance, the DAC sampling rate information and the information indicating whether the SBR is used are usable. In particular, if the DAC sampling rate is 32 kHz and if the SBR is used, the AAC sampling rate becomes 16 kHz.

Meanwhile, in DAB (digital audio broadcasting) system, the number of samples per channel of sub-frames can be set to a specific value. The specific value may be provided for compatibility with information of another codec. For instance, the specific value can be set to 960 to achieve compatibility with length information of sub-frames of HE-AAC. In this case, a temporal length of sub-frame becomes 960/16 kHz=60 ms. So, if a temporal length of a main frame is fixed to a specific value (120 ms) with respect to time, the number of sub-frames becomes 120 ms/60 ms=2. As mentioned in the foregoing description, if the number of the sub-frames is decided, start position information amounting to the number of the sub-frames can be obtained. Yet, in this case, the start position information for an initial sub-frame can be decided by preset information.

According to an embodiment of the present invention, size information of sub-frame (sf_size[n]) can be derived using the start position information of the sub-frame. For instance, size information of a previous sub-frame can be derived using start position information of a current sub-frame and start position information of a previous sub-frame. In doing so, if information for checking error of sub-frame exists, it can be used together. This can be expressed as Formula 1.

$$sf_size[n-1]=sf_start[n]-sf_start[n-1]+sf_CRC[n-1] \quad \text{[Formula 1]}$$

Thus, once the size of sub-frame is decided, it is able to allocate bits of the sub-frame using the decided size of the sub-frame.

According to an embodiment of the present invention, it is able to decide a size of a main frame using a subchannel index. In this case, the subchannel index may mean number information of RS (Reed-Solomon) packets needed to carry the main frame. And, the subchannel index value can be decided from a subchannel size of MSC (main service channel).

For instance, if a subchannel index is 1, a subchannel size of MSC becomes 8 kbps. In this case, a main frame length (120 ms) becomes 120 ms×8 k=960 bits. Namely, the main frame length becomes 120 bytes. Yet, since 10 bytes among 120 bytes become overhead for other use, 110 bytes are usable only. Hence, the size of the main frame becomes 110 bytes.

If the number of sub-frames is 4 and if sizes of sub-frames are 50, 20, 20, and 20, respectively, start position information of the sub-frames becomes 50, 70, and 90 but start position information of an initial sub-frame may not be sent.

Figure 3:
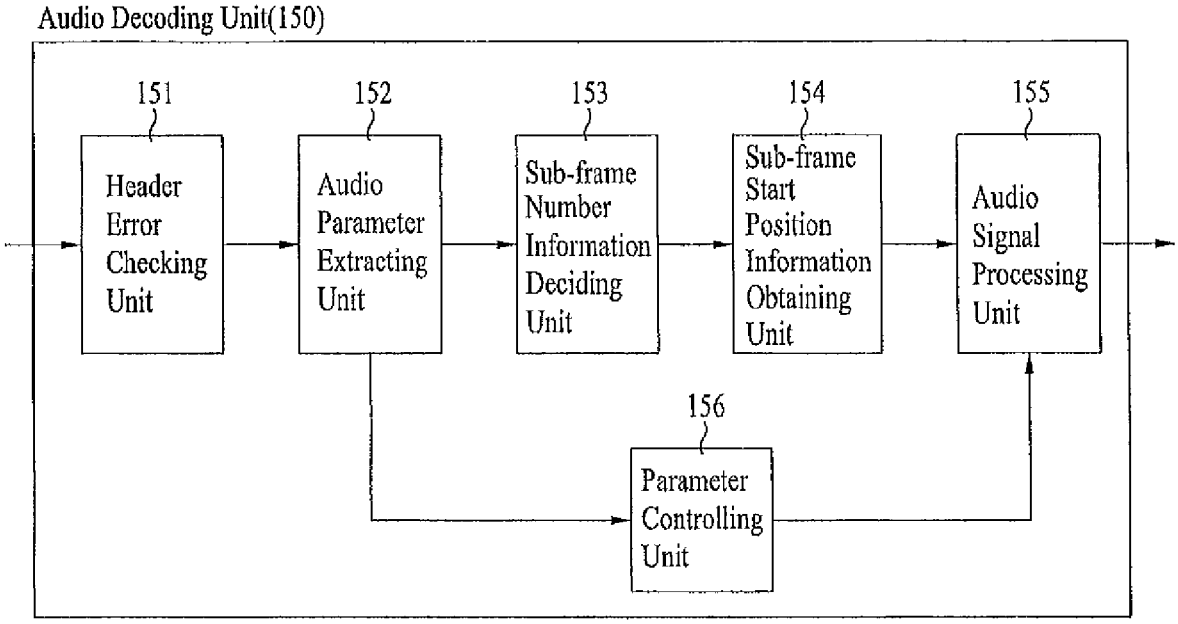
FIG. 3 is a schematic block diagram of an audio decoding unit 150 for processing a transmitted audio signal according to an embodiment of the present invention.

FIG. 3 is a schematic block diagram of an audio decoding unit 150 for processing a transmitted audio signal according to an embodiment of the present invention.

Referring to FIG. 3, an audio decoding unit 150 includes a header error checking unit 151, an audio parameter extracting unit 152, an sub-frame number information deciding unit 153, an sub-frame start position information obtaining unit 154, an audio signal processing unit 155, and a parameter controlling unit 156.

The audio decoding unit 150 receives the system information or the broadcast service information from the data decoding unit 140 and decodes a transmitted audio signal compressed by specific audio coding scheme. In decoding the transmitted audio signal, a syncword within a main frame header is preferentially searched for, RS (Reed-Solomon) decoding is performed, and information within the main frame can be then decoded. In doing so, to raise reliability of syncword decision of the main frame header, various methods are applicable.

According to an embodiment of the present invention, the header error checking unit 151 checks whether there exist error in a header of a main frame of a transmitted audio signal. In doing so, various embodiments are applicable to the error detection.

For instance, it is checked whether a reserved field exists in the main frame header. If the reserved field exists, error can be detected in a manner of checking whether a specific value exists.

For another instance, error can be detected in manner of checking whether a use restriction condition between audio parameters is met. In particular, in case that channel mode information is stereo, if parametric stereo is applied, it can be recognized that error exits. Or, in case that SBR is not applied, if parametric stereo is applied, it can be recognized that error exists. Or, if both parametric stereo and MPEG surround is applied, it can be recognized that error exits. Thus, if it is recognized that the error exists in the main frame header, it is decided that wrong syncword is detected.

The audio parameter extracting unit 152 is able to extract an audio parameter from the main frame header. In this case, the audio parameter includes sampling rate information, information indicating whether SBR is used, channel mode information, information indicating whether parametric stereo is used, MPEG surround configuration information, etc, which have been explained in detail with reference to FIG. 2.

The sub-frame number information decoding unit 153 is able to decide number information of the sub-frames configuring the main frame using the audio parameter outputted from the audio parameter extracting unit 152. For instance, the DAC sampling rate information and the information indicating whether SBR is used are used as the audio parameters.

The sub-frame start position information obtaining unit 154 is able to obtain start position information of each sub-frame using the number information of the sub-frames outputted from the sub-frame number information decoding unit 153. In this case, the start position information of the initial sub-frame within the main frame can be given as preset information instead of being transmitted. For instance, the preset information may include the table information decided based on the header length of the main frame. In case that the obtained start position information of the each sub-frame is used, if error occurs in an arbitrary portion of the main frame, it is able to prevent other data from being lost.

The parameter controlling unit 156 is able to check whether the mutual use restriction condition between the audio parameters extracted by the audio parameter extracting unit 152 is met or not. For instance, if both the parametric stereo information and the MPEG surround information are inserted in the audio signal, both of them may be usable. Yet, if one of them is used, the other can be ignored.

MPEG surround is able to make 1-channel to 5.1 channels (515 mode) or 2-channels to 5.1-channels (525 mode). So, in case of mono according to the channel mode information, the 515 mode is usable. In case of stereo, the 525 mode is usable. The configuration information of the MPEG surround can be configured based on profile information of the audio signal. For instance, if a level of MPEG surround profile is 2 or 3, it is able to use channels up to 5.1-channels as output channels. Thus, the audio parameters are selectively usable.

The audio signal processing unit 155 selects suitable codec according to parameter control information outputted from the parameter controlling unit 156 and is able to efficiently process the audio signal using the start position information of the sub-frames outputted from the sub-frame start position information obtaining unit 154.

Figure 4:
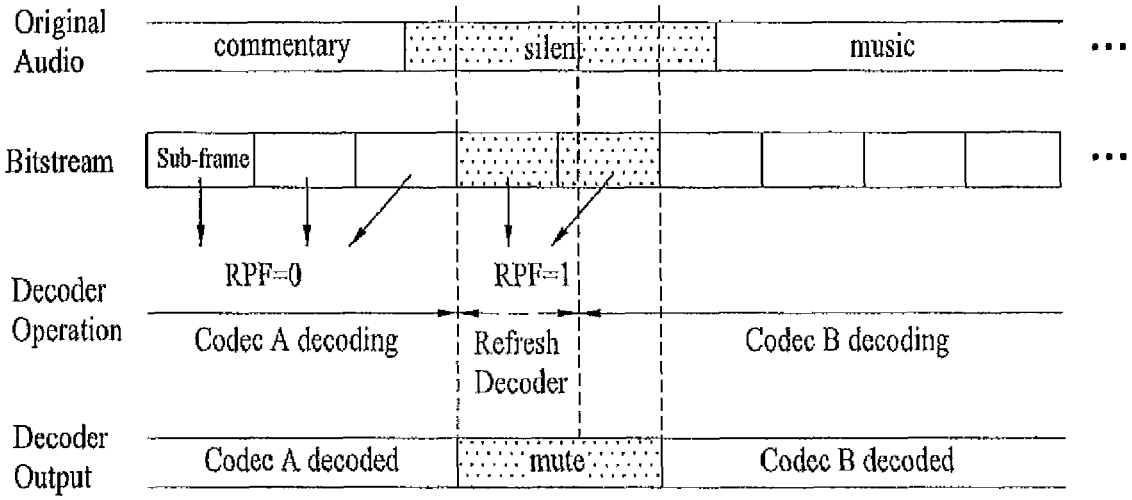
FIG. 4 is a diagram to explain a process for inserting refresh information in an audio bitstream and processing in a decoding unit according to an embodiment of the present invention.

FIG. 4 is a diagram to explain a process for inserting refresh information in an audio bitstream and processing in a decoding unit according to an embodiment of the present invention.

Referring to FIG. 4, in transmission of temporally consecutive data such as an audio signal, it is not preferable that a discontinuous section occurs in the middle of the transmission in aspect of a receiving side. The discontinuous section is generated from various reasons including stream error due to transmission error, environmental change for requiring a reset of a decoder (e.g., change of sampling frequency, change of codec, etc.), channel change due to user's selection, etc.

In case that a channel or program is changed by user's selection, a mute of an audio signal is generated within a time delay section according to the channel change. So, it is insignificant if the section is short. Yet, in case that the environmental change for requiring a reset of a decoder is necessary, unnecessary distortion is generated in a receiving side if the corresponding position is inappropriate.

In digital signal transmission for a broadcast service, a plurality of codecs are defined to use an advantageous codec according to a selection for a broadcasting station and then selectively used. In the A/V broadcast service using a plurality of codecs, if there occurs a case of changing codec in progress of the corresponding broadcast, a decoding device for the corresponding codec usually performs resetting and new decoding needs to be executed using a new codec. In particular, in order to change codec without resetting, a plurality of codecs are always in standby mode to instantaneously cope with a case that codec is changed for each sub-frame.

So, according to an embodiment of the present invention, refresh information can be inserted in a header of a main frame configuring an audio signal. In this case, the refresh information may correspond to information indicating whether the audio signal will be processed using new information different from information of a current main frame or current sub-frame.

According to one embodiment of the present invention, the refresh information can be set to refresh point flag information indicating that refresh is available at a suitable position. In this case, the refresh point flag information can be generated or provided in various ways. For instance, there are a method of notifying that refresh is available for each corresponding sub-frame, a method of notifying that a refreshable section starts from a current sub-frame and how many sections it will exist, a method of notifying start and end of a refreshable point, and the like. Moreover, there can exist a method of including additional information indicating a reason or level of refresh. For instance, the additional information includes such information as codec change, sampling frequency change, audio channel number change, etc. And, the refresh information can be the concept including all information associated with the refresh.

Although such a reason as a codec change does not exist, if a silent section over a sub-frame length exists in an audio signal, the refresh associated information can be transmitted with a proper interval. A decoding device efficiently uses the information for a section for maintenance such as time alignment for A/V lipsync, thereby enhancing a quality of broadcast contents.

According to an embodiment of the present invention, there is an example of a moment that an original audio signal to be broadcasted is about to enter Music via a voice section of an announcer or DJ. In particular, assuming that a commentary section uses 2-channel HE-AAC V2 codec and that music uses 5.1-channel AAC+MPEG Surround codec, a decoding device between the two sections needs to change its codec for decoding. In this case, if a silent section exists between the two sections, the refresh point flag (RPF) in the sub-frame within the silent section is set to 1 to be transmitted. This is because, if a codec change situation occurs in a significant value of audio contents, i.e., in a section where sound exists, distortion is generated due to disconnection. So, it may be preferable that the refresh information is inserted in a relatively insignificant section.

While the decoding device performs decoding by 2-channel HE-AAC V2 codec, it checks whether to perform refresh at a timing point at which the refresh point flag is changed into 1. In this case, a change of codec is confirmed through another additional information and a preparation such as a download of new codec and the like is made to perform decoding by new codec (AAC+MPEG Surround). The change can be performed while the refresh point flag is 1. Once the refresh operation is completed, decoding is initiated by the new codec.

Since it is unable to output a decoded signal via DAC during the refresh section, a signal in a mute mode can be outputted. Since the information having the refresh point flag set to 1 is transmitted within the silent section, cutoff or distortion of an output signal of the decoding device is not sensible even if a mute signal is outputted while the refresh point flag is set to 1.

FIG. 5 is a diagram to explain various examples for a method of transmitting refresh information according to an embodiment of the present invention.

FIG. 5(*a*) is a diagram to explain a transmitting method of inserting refresh point information (bsRefreshPoint) in a sub-frame.

Referring to FIG. 5(*a*), for instance, it is able to allocate 1 bit to a sub-frame. If the refresh point information is 1, a corresponding sub-frame may be refreshable.

FIG. 5(*b*) is a diagram to explain a transmitting method of inserting refresh start information (bsRefreshStart) in a sub-frame and inserting refresh duration information (bsRefreshDuration) indicating a duration available for refresh execution if refresh is applied.

Referring to FIG. 5(*b*), the refresh start information can exist as a basic 1-bit in a sub-frame. If this value is 1, n bits can be further transmitted in addition. In this case, refresh execution may be available for a corresponding sub-frame to sub-frames amounting to the number corresponding to the refresh duration information. A decoding device is able to recognize how many sections available for refresh exist.

FIG. 5(*c*) is a diagram to explain a transmitting method of inserting refresh point information (bsRefreshPoint) indicating refresh available and refresh stop information (bsRefreshStop) to stop the refresh in a sub-frame.

Referring to FIG. 5(*c*), 2-bit refresh point information and refresh stop information exist in a sub-frame. If the refresh point information is 1, it means that refresh is available for a current sub-frame. If the refresh stop information is not set to 1, it can be recognized in advance that the refresh point information is 1 in a next sub-frame. In order to make the refresh point information set to 0 in a next frame, the refresh stop information in a current frame should be set to 1.

FIG. 6 is a diagram (a) to explain a method of transmitting reason information of refresh, and a diagram (b) to explain examples of reason information of refresh.

Referring to FIG. 6(*a*), for a sub-frame of which refresh point information is set to 1, source information (bsRefreshSource) corresponding to its refresh reason can be transmitted as m bits in addition. The protocol for a source value and a bit number m can be negotiated between the encoding and decoding devices in advance. For instance, mapping shown in FIG. 6(*b*) can be performed.

FIG. 7 is a diagram (a) to explain a method of transmitting level information to provide refresh extendibility, and an exemplary diagram of level information.

Referring to FIG. 7(*a*), for a sub-frame of which refresh point information is set to 1, minimum level information requested by a decoding device can be transmitted as k bits in addition. For instance, the level can be agreed as FIG. 7(*b*).

The above-explained various embodiments are reciprocally combined to be complexly transmitted.

Another embodiments of the present invention will be made in detail.

In a coding scheme of a multi-channel audio signal, transmission efficiency of the multi-channel audio signal can be effectively enhanced using a compressed audio signal (e.g., stereo audio signal, mono audio signal) and low rate side information (e.g., spatial information).

MPEG Surround for encoding multi-channels using a spatial information parameter conceptionally includes a technique of encoding a stereo signal using such a parameter as parametric stereo. Yet, there is a problem that bit-stream compatibility between MPEG surround and parametric stereo is not available due to a syntax definition difference, a technical feature difference, and the like. For instance, it is impossible to decode a bitstream encoded by parametric stereo using an MPEG surround decoder, and vice versa. In this case, the MPEG surround coding scheme and the parametric coding scheme are just exemplary. And, the present invention is applicable to other coding schemes.

To solve the problem, the present invention proposes a method of generating a bitstream suitable for a format of an outputting signal. For instance, there is a case that bitstream-A is converted to bitstream-B to be transmitted or stored. In this case, if a transport channel or decoder compatible with the bitstream-B exists already, compatibility is maintained by adding a converter. There may be a case that a decoder capable of decoding bitstream-B attempts to decode bitstream-A. This is the structure suitable for configuring a decoder capable of decoding both of the bitstream-A and the bitstream-B by modifying the decoder corresponding to the bitstream-B in part. Details of theses embodiments are explained with reference to the accompanied drawings as follows.

FIG. 8 is a schematic block diagram of a system for compatibility between bitstream-A and bitstream-B according to one embodiment of the present invention.

Referring to FIG. 8, a system for compatibility between bitstream-A and bitstream-B according to one embodiment of the present invention includes an A-demultiplexing unit 810, an A-to-B converting unit 830, a B-multiplexing unit 850, and a controlling unit 870.

The A-to-B converting unit 830 can include a first converting unit 831 converting information requiring a converting process for generating a new bitstream and a second converting unit 833 converting side information necessary to complement the information.

In case of attempting to decode a bitstream encoded by a first coding scheme using a decoder suitable for a second coding scheme, it is assumed that the first and second coding schemes are parametric stereo scheme and MPEG surround scheme, respectively for example.

The A-demultiplexing unit 810 receives a bitstream coded by the parametric stereo scheme and then separates parameter information and side information configuring the bitstream. The separated information are then transferred to the A-to-B converting unit 830.

The A-to-B converting unit 830 can perform a work for converting the received parametric stereo bitstream to MPEG surround bitstream.

And, parameter information and side information transmitted by the A-demultiplexing unit 810 can be transferred to the first converting unit 831 and the second converting unit 833, respectively.

The first converting unit 831 is capable of converting the transmitted parameter information. In this case, the transmitted parameter information may include various kinds of parameter information necessary to configure a bitstream coded by parametric stereo scheme.

For instance, the various kinds of the parameter information can include IID (inter-channel intensity difference) information, IPD (inter-channel phase difference) and OPD (overall phase difference) information, ICC (inter-channel coherence) information, and the like. In this case, the IID information means relative levels of a band-limited signal. The IDP and OPD information indicates a phase difference of the band-limited signal. And, the ICC information indicates correlation between a left band-limited signal and a right band-limited signal.

In this case, the parameter information the first converting unit 831 attempts to convert may include parameter informations to apply MPEG surround scheme. In particular, the parameter informations may correspond to parameters such as spatial information and the like. For instance, the parameter informations may include CLD (channel level difference) indicating an inter-channel energy difference, ICC (inter-channel coherences) indicating inter-channel correlation, CPC (channel prediction coefficients) used in generating three channels from two channels, and the like.

So, the first converting unit 831 can perform parameter conversion using the correspondent relations between parameter informations required for the parametric stereo scheme and parameter informations required from the MPEG surround scheme. This shall be explained in detail with reference to FIG. 10 later.

The second converting unit 833 is capable of converting side information transmitted by the A-demultiplexing unit 810. In the side information, side information in a format compatible with bitstream-B can be directly transferred to the B-multiplexing unit 850 without a special conversion process. In this case, a simple mapping work may be necessary. For instance, there can be time/frequency grid information or the like.

Yet, incompatible informations may be differently processed. For instance, information unnecessary for a decoding process of the bitstream-B may be discarded. Information, which needs to be represented in another format to decode the bitstream-B, undergoes a conversion process and is then transferred to the B-multiplexing unit 850.

The B-multiplexing unit 850 is able to configure bitstream-B using the parameter informations transferred from the first converting unit 831 and the side informations transferred from the second converting unit 833.

In this case, the controlling unit 870 receives control information necessary for conversion by the second coding scheme and then controls an operation of the A-to-B converting unit 830. For instance, the operation of the A-to-B converting unit 830 may vary according to adjustment of a control variable decided in correspondence to a target data rate/quality or the like for the format of the bitstream-B.

In particular, if a data rate of a parametric stereo bitstream is higher than that of an MPEG surround bitstream, abbreviation can be carried out on spatial information in part. In this case, the abbreviation includes a method of decimation, a method of taking an average or the like.

For a time/frequency direction, it can be processed bidirectionally or in one direction. Yet, in case that a target data rate in higher than an input data rate, information can be added. For this, various interpolation schemes in time/frequency direction are available.

Moreover, information impossible to be converted may exist in a parameter converting process. In this case, the conversion-impossible information is omitted or replaced according to representation in another format. For a factor considerably affecting a sound quality, it may be preferable that pseudo-information is transferred via replacement.

According to another embodiment of the present invention, it is assumed that the first and second coding schemes are SAOC (spatial audio object coding) and MPEG surround schemes, respectively.

The SAOC scheme is the scheme for generating an independent audio object signal unlike channel generation of MPEG surround. So, in case of attempting to decode bitstream coded by the SAOC scheme using a decoder suitable for the MPEG surround coding scheme, it is necessary to convert the bitstream coded by the SAOC scheme to MPEG-surround bitstream.

The A-demultiplexing unit 810 receives the bitstream coded by the SAOC scheme and is able to separate parameter information and side information from the received bitstream. The separated informations are transferred to the A-to-B converting unit 830.

The A-to-B converting unit 830 is capable of performing a work for converting the received SAOC bitstream to MPEG-surround bitstream.

The parameter and side informations transferred from the A-demultiplexing unit 810 can be transferred to the first and second converting units 831 and 833, respectively.

The first converting unit 831 is able to convert the transferred parameter information. In this case, the transferred parameter information may include parameter informations necessary to configure bitstream coded by SAOC. For instance, the parameter informations can be associated with an audio object signal. In this case, the audio object signal can include a single sound source or complex mixtures of several sounds. And, the audio object signal can be configured with mono or stereo input channels.

In this case, the parameter information the first converting unit 831 attempts to convert may include parameter informations to apply MPEG surround scheme. So, the first converting unit 831 can perform parameter conversion using correspondence between the parameter informations needed by the MPEG surround scheme and the parameter informations needed by the SAOC scheme.

The first converting unit 831 can include a rendering unit (not shown in the drawing). In this case, 'rendering' may mean that a decoder generates an output channel signal using an object signal. In case of receiving at least one downmix signal and a stream of side information, the rendering unit is able to transform object signals to generate a desired number of output channels. In this case, parameters of the rendering unit to transform the object signals can be controlled through interactivity with a user.

The second converting unit 833 is able to convert the side information transferred from the A-demultiplexing unit 810. In the side information, side information in a format compatible with bitstream-B can be directly transferred to the B-multiplexing unit 850 without a special conversion process. In this case, a simple mapping work may be necessary. Yet, incompatible informations may be differently processed. For instance, information unnecessary for a decoding process of the MPEG surround bitstream may be discarded. Information, which needs to be represented in another format to decode the MPEG surround bitstream, undergoes a conversion process and is then transferred to the B-multiplexing unit 850.

The B-multiplexing unit 850 is able to configure bitstream-B using the parameter informations transferred from the first converting unit 831 and the side informations transferred from the second converting unit 833.

In this case, the controlling unit 870 receives control information necessary for conversion by the second coding scheme and then controls an operation of the A-to-B converting unit 830. For instance, the operation of the A-to-B converting unit 830 may vary according to adjustment of a control variable decided in correspondence to a target data rate/quality or the like for the format of the bitstream-B.

In particular, if a data rate of SAOC bitstream is higher than that of MPEG surround bitstream, abbreviation can be carried out on spatial information in part.

According to a further embodiment of the present invention, another structure of the A-to-B converting unit 830 is proposed. And, a core audio signal can be added as a signal inputted to the A-to-B converting unit 830. The core audio signal means a signal utilizable in the A-to-B converting unit 830.

For instance, in case that bitstream-A is MPEG surround bitstream, the core audio signal can be a downmix signal. In case that the bitstream-A is a parametric stereo bitstream, the core audio signal can be a mono signal. By utilizing the core audio signal, it is able to reinforce unspecific or insufficient information in a bitstream converting process.

FIG. 9 is a schematic block diagram of a system for compatibility between bitstream-A and bitstream-B according to another embodiment of the present invention.

Referring to FIG. 9, the system is applicable to a case that a decoder capable of decoding bitstream-B receives and decodes bitstream-A. By modifying the decoder corresponding to the bitstream-B in part, the system is suitable for configuring a decoder capable of decoding both of the bitstream-A and the bitstream-B.

In particular, the system includes an A-demultiplexing unit 810, an A-to-B converting unit 830, a B-multiplexing unit 910, and a B-decoding unit 930. Unlike the former system described in FIG. 8, the present system needs not to perform packing in a bitstream format. So, the B-multiplexing unit 810 and the controlling unit 870 shown in FIG. 8 may be unnecessary.

Functions and operations of the A-demultiplexing unit 810, the first converting unit 831 and the second converting unit 833 are similar to those described in FIG. 8. Since outputs of the first and second converting units 831 and 832 can be directly inputted to the B-decoding unit 930, this embodiment can be more efficient in aspect of a quantity of operation than the former embodiment. In this case, the B-decoding unit 930 may need to be partially modified to receive and process data in an intermediate format differing from the bitstream-B.

In case of receiving the bitstream-B, for instance, if the bitstream-B is MPEG surround bit stream, spatial parameter information and its side information are outputted to the B-decoding unit 930. In this case, the B-decoding unit 930 is able to directly decode the bitstream-B. Through the above-explained decoding method, it is able to decode both of the bitstream in the format-A and the bitstream in the format-B.

FIG. 10 is an exemplary diagram of parameter information transformed in the course of converting a parametric stereo signal to an MPEG surround signal according to an embodiment of the present invention.

Referring to FIG. 10, assuming that first and second coding schemes are parametric stereo and MPEG surround, respectively, a bitstream coded by the first coding scheme is to be decoded by a decoder suitable for the second coding scheme.

The first converting unit 831 shown in FIG. 8 or FIG. 9 is able to perform parameter transform using the correspondence between parameter informations required for the parametric stereo scheme and the parameter informations required for the MPEG surround scheme. This can be analogically applied to a case that the first and second coding schemes are the MPEG surround scheme and the parametric stereo scheme, respectively.

IID information among parameters of the parametric stereo can be transformed to CLD information as a parameter of the MPEG surround. A value of 'Default grid IID' shown in FIG. 10 means index information and a value of 'Value' means an actual IID value. And, corresponding CLD information indicates index information transformed using a fine quantizer or a coarse quantizer. In transformation using the coarse quantizer, a separate coping skill may be necessary for a colored part shown in FIG. 10. And, ICC information corresponds to parameter information of parametric stereo or parameter information of MPEG surround for 1:1 matching.

INDUSTRIAL APPLICABILITY

Accordingly, the present invention can provide a medium for storing data to which at least one feature of the present invention is applied.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A method of processing an audio signal, comprising:

receiving, by an audio processing apparatus, a bitstream corresponding to the audio signal, the audio signal comprising a main frame including a header and a plurality of sub-frames;

extracting sampling rate information and information indicating whether Spectral Band Replication (SBR) has been used for the audio signal, from the header;

deciding a number of sub-frames included in the main frame using the sampling rate information and the information indicating whether the SBR has been used for the audio signal;

obtaining start position information of a sub-frame from the header based on the number of sub-frames; and processing the audio signal based on the start position information of the sub-frame.

2. The method of claim 1, further comprising:

extracting channel mode information, information indicating whether parametric stereo has been used, and MPEG surround configuration information, wherein the audio signal is further processed by decoding based on the channel mode information, the information indicating whether parametric stereo has been used, and the MPEG surround configuration information.

3. The method of claim 2, wherein the parametric stereo is used if the SBR has been used and if the channel mode is mono.

4. The method of claim 2, wherein the MPEG surround configuration information is decided as one of various modes based on profile information.

5. The method of claim 4, wherein if t both the data information for the parametric stereo and the data information for MPEG surround are received, performing one of parametric stereo and MPEG surround on the audio signal.

6. The method of claim 1, further comprising:

deriving size information of the sub-frame from the start position information of the sub-frame.

7. The method of claim 1, wherein the main frame corresponds to a specific value with respect to time.

8. The method of claim 1, further comprising extracting error check information of the sub-frame according to the number of the sub-frame.

9. The method of claim 1, wherein the start position information of the sub-frame represents a number of bytes on the bitstream.

10. In a broadcast receiver capable of receiving a digital broadcast, a digital broadcast receiver comprising:

a tuner unit configured to receive a broadcast bitstream corresponding to an audio signal, wherein the audio signal comprises a main frame including a header and a plurality of sub-frames; and an audio decoding unit configured to:

extract sampling rate information and information indicating whether Spectral Band Replication (SBR) has been used for the audio signal, from the header;

decide a number of sub-frames included in the main frame using the sampling rate information and the information indicating whether the SBR has been used for the audio signal;

obtain start position information of a sub-frame from the header based on the number of sub-frames; and process the audio signal based on the start position information of the sub-frame.

* * * * *